United States Patent [19]

Avery

[11] 3,934,603

[45] Jan. 27, 1976

[54] FLUIDIC UPSTREAM CONTROL OF THE DIRECTIONAL FLOW OF A POWER JET EXITING A FLUIDIC POWER NOZZLE

[75] Inventor: Howard William Avery, Schenectady, N.Y.

[73] Assignee: General Electric Company, New York, N.Y.

[22] Filed: Jan. 8, 1974

[21] Appl. No.: 431,592

[52] U.S. Cl. ..... 137/83; 137/829

[51] Int. Cl.[2] ..... F15C 3/10

[58] Field of Search ..... 137/83, 829, 830, 831, 137/85, 82

[56] References Cited

UNITED STATES PATENTS

| | | | |
|---|---|---|---|
| 2,928,409 | 3/1960 | Johnson et al. | 137/82 |
| 3,209,775 | 10/1965 | Dexter et al. | 137/829 |
| 3,223,103 | 12/1965 | Trinklel | 137/83 |
| 3,266,511 | 8/1966 | Torick | 137/831 |
| 3,269,419 | 8/1966 | Dexter | 137/830 |
| 3,276,463 | 10/1966 | Bowles | 137/831 |
| 3,286,719 | 11/1966 | Myers | 137/83 |
| 3,424,183 | 1/1969 | Coakley | 137/83 |
| 3,433,133 | 3/1969 | Brewer et al. | 137/83 X |
| 3,456,665 | 7/1969 | Pavlin | 137/829 X |
| 3,460,436 | 8/1969 | Takeda | 137/83 X |
| 3,556,119 | 1/1971 | Ankeney | 137/831 |
| 3,621,859 | 11/1971 | Scott | 137/829 |
| 3,678,746 | 7/1972 | Corey | 137/829 X |
| 3,750,482 | 8/1973 | Kast | 137/830 X |

FOREIGN PATENTS OR APPLICATIONS

| | | | |
|---|---|---|---|
| 1,077,308 | 7/1967 | United Kingdom | 137/829 |

*Primary Examiner*—William R. Cline

*Attorney, Agent, or Firm*—Stephen A. Young; Robert A. Cahill; Frank L. Neuhauser

[57] ABSTRACT

A fluidic device having a plenum chamber, an input port to the chamber for receiving a supply of gas, and a power nozzle contiguous with the plenum chamber for generating a power jet. Means is located upstream of the power nozzle for controlling the directional flow of the power jet exiting the power nozzle. The controlling means is comprised of an elongated movable element, so positioned within the plenum chamber to be surrounded by the gas therein, and means for adjusting the position of one end of the element relative to the axis of the power nozzle for controlling the directional flow of the power jet exiting the nozzle. The fluidic device forms part of a fluidic amplifier having at least first and second fluidic receivers positioned downstream from the power nozzle. The first receiver is axially aligned with the power nozzle for receiving the power jet when one end of the element is normally axially aligned with and located adjacent the power nozzle. The second receiver is angularly displaced in a first direction from the axis of the power nozzle for receiving the power jet when the position of the one end of the element is varied in the first direction relative to the axis of the power nozzle.

13 Claims, 4 Drawing Figures

FLUIDIC UPSTREAM CONTROL OF THE DIRECTIONAL FLOW OF A POWER JET EXITING A FLUIDIC POWER NOZZLE

BACKGROUND OF THE INVENTION

1. Field of The Invention

This invention relates to a fluidic device for controlling the directional flow of a power jet exiting a power nozzle, and also to a fluidic amplifier incorporating this device.

2. Description of The Prior Art

As disclosed in U.S. Pat. No. 3,451,412, it has been well known to control the directional flow of a fluid jet exiting a power nozzle downstream from the power nozzle. However, the location of a controlling element downstream from the power nozzle can cause interference with the proper performance of an entire fluidic device, such as a fluidic amplifier, and such interference can occur even when the downstream controlling mechanism is not malfunctioning.

Alternatively, it has been suggested in U.S. Pat. No. 3,269,419 that a piezo-electric device be imbedded within a wall of or upstream of a power nozzle. When the piezo-electric device is excited, the fluid jet exiting the nozzle is converted from a laminar flow to a turbulent flow, whereby the turbulently flowing fluid jet becomes latched to a side wall of the fluidic device. Thus, the directional flow of a fluid jet can be switched between a first and a second receiver as the fluid jet changes from laminar flow to turbulent flow and vice versa. However, since the turbulent flowing jet latches to the side wall which is immediately adjacent the imbedded piezo-electric device, the flexibility and degree of control over the directional flow of the power jet exiting the nozzle is thereby limited. More specifically, the device described in U.S. Pat. No. 3,269,419 is incapable of operating as a proportional amplifier, and is restricted solely to digital operation. Furthermore, in order for the device to be operative, the receiver, which is angularly displaced from the axis of the nozzle, must be precisely positioned. Still further, the switching of the jet flow from laminar to turbulent flow is sensitive and sometimes difficult to achieve.

OBJECTS OF THE INVENTION

It is therefore an object of this invention to provide an improved fluidic device for controlling the directional flow of a power jet upstream of a power nozzle.

It is another object of this invention to provide an improved fluidic amplifier which has incorporated therein an improved means for controlling the directional flow of a power jet upstream of a power nozzle.

It is another object of this invention to provide improved means for controlling the directional flow of a power jet upstream of a power nozzle such that the device is readily adaptable as part of either a fluidic proportional or fluidic digital amplifier.

It is another object of this invention to provide a fluidic device for controlling the directional flow of a power jet upstream of a power nozzle, such that the directional flow can be easily and conveniently controlled by either manual, mechanical, magnetic or electrical means.

Other objects of the invention will be pointed out in and understood from the following.

SUMMARY OF THE INVENTION

In accordance with a broad aspect of the invention there is provided a fluidic device having a plenum chamber, an input port to the chamber for receiving a supply of fluid and a power nozzle contiguous with the plenum chamber for generating a power jet. Means is located upstream of the power nozzle for controlling the directional flow of the power jet exiting the power nozzle. The controlling means is comprised of an elongated movable element, so positioned within the plenum chamber as to be surrounded by the power jet exiting therefrom, and means for adjusting the position of one end of the element relative to the axis of the power nozzle for controlling the directional flow of the power jet exiting the nozzle. One end wall of the plenum chamber is defined by a plate, and the power nozzle is defined by a sharp edge orifice formed within and extending through the plate. Another end of the element is fixed with another end wall of the plenum chamber, whereby the element is cantilevered and centrally positioned within the plenum chamber. The fluidic device can form part of a fluidic amplifier having at least first and second fluidic receivers positioned downstream from the power nozzle. The first receiver is axially aligned with the power nozzle for receiving the power jet when the element is normally axially aligned with and located adjacent the power nozzle. The second receiver is angularly displaced in a first direction from the axis of the power nozzle for receiving the power jet when the position of the one end of the element is varied in the first direction relative to the axis of the power nozzle. The fluidic amplifier can have a third fluidic receiver angularly displaced in a second direction opposite the first direction from the axis of the power nozzle for receiving the power jet when the position of the one end of the element is varied in the second direction relative to the axis of the power nozzle.

DESCRIPTION OF THE PREFERRED EMBODIMENT

Referring to FIGS. 1 through 4, the invention will now be described.

Figure 1:
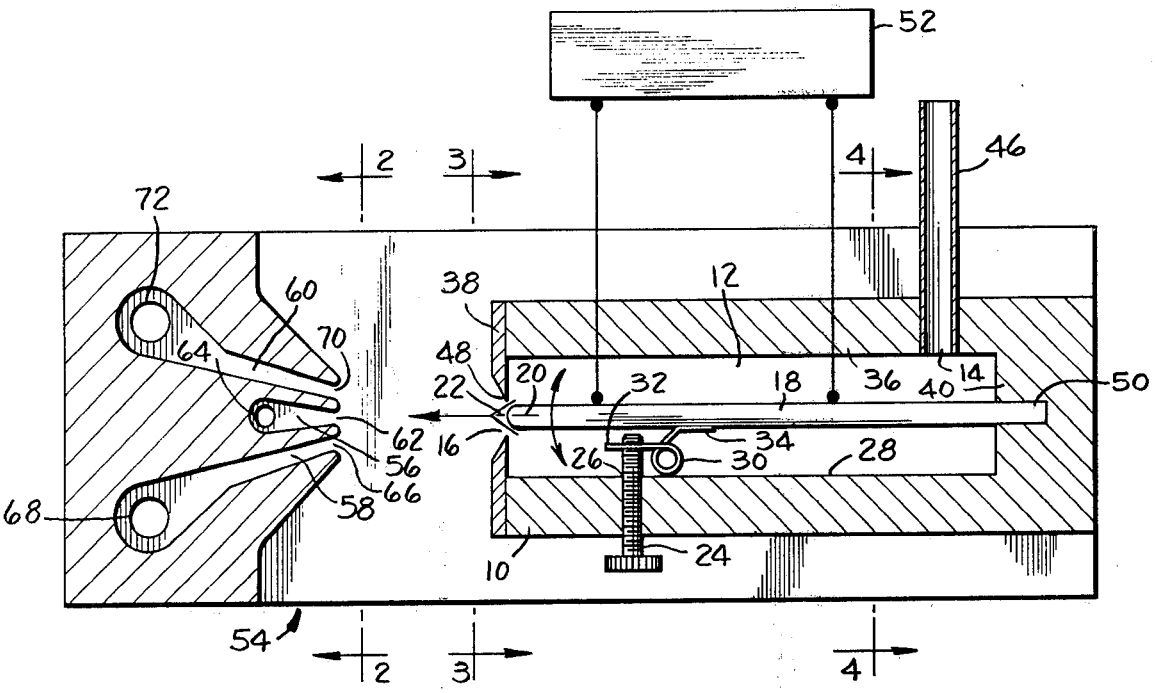
FIG. 1 is a top cross sectional view of the fluidic amplifier taken along the longitudinal axis of the power nozzle.

A fluidic device 10, shown in FIG. 1, has a plenum chamber 12, an input port 14 to the plenum chamber for receiving a supply of gas, and a power nozzle 16 contiguous with the plenum chamber for generating a power (fluidic) jet. The device also includes means located upstream of the power nozzle for controlling the directional flow of the power jet exiting the power nozzle. The controlling means is comprised of an elongated movable element 18, and means for adjusting the position of one end 20 of the element relative to the axis 22 of the power nozzle for controlling the directional flow of the power jet exiting the nozzle. The adjusting means is comprised of a control screw 24, threaded through a tapped hole 26 in a side wall 28 of and extending into plenum chamber 12, and a spring 30 positioned within the plenum chamber for biasing element 18. One end 32 of spring 30 is fixed to control screw 24, while the other end 34 of spring 30 is fixed to element 18.

Figure 3:
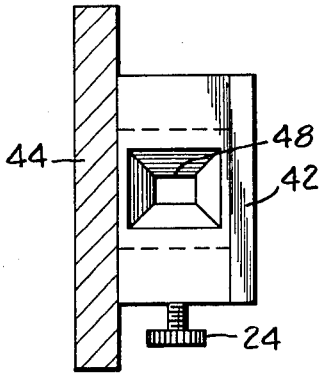
FIG. 3 is a side sectional view of the amplifier shown in FIG. 1 taken along lines 3—3 and showing the sharp edged orifice defining the power nozzle.
Figure 4:
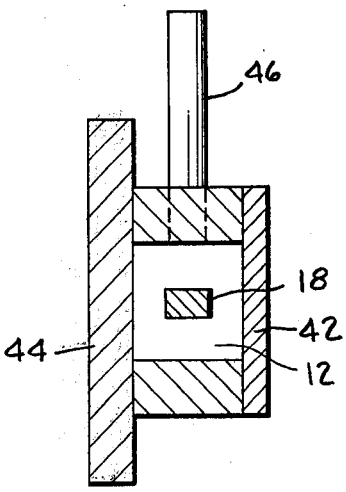
FIG. 4 is a cross sectional view of the amplifier shown in FIG. 1 taken along lines 4—4 and showing the interior of the plenum chamber.

Plenum chamber 12 is defined by side wall 28 and an oppositely disposed side wall 36, an end wall 38 and an oppositely disposed end wall 40, and respective top and bottom sections 42 and 44, shown in FIGS. 3 and 4. The plenum chamber is fluidically coupled to a source (not shown) of fluid such as air, by means of a standard fluidic connector 46 which has one end thereof fluidically connected to input port 14. End wall 38 of plenum chamber 12 is defined by a plate, and power nozzle 16 is defined by a sharp edged rectangularly shaped orifice 48 in the plate shown in FIG. 3. By way of example only, orifice 48 can have a height and width, referring to FIG. 3, of approximately 0.032 inches by 0.070 inches, while the moving element can be similarly dimensioned with its end 20 spaced approximately 0.05 inches from orifice 48. Under these circumstances, when end 20 of element 18 is shifted approximately 0.015 inches from the axis of the nozzle, the power jet shifts in the same direction approximately 15 degrees.

While end 20 of element 18 is axially aligned with and positioned adjacent power nozzle 16, the other end 50 of the element is fixed within end wall 40 so that the element is cantilevered within the plenum chamber. The cantilevered element is spaced from side walls 28 and 36 and top and bottom sections 42 and 44 to be approximately centrally positioned within the plenum chamber and surrounded by the gas therewithin. While end 50 of element 18 is shown fixed within end wall 40, alternatively, end 50 of element 18 can be positioned within plenum chamber 12 and supported by a control screw and biasing spring similar to that of control screw 24 and 30.

The position of end 20 of element 18 can be adjusted relative to the axis of power nozzle 16 to vary the directional flow of the power jet exiting the nozzle by either manually or mechanically turning control screw 24 either in the clockwise or counterclockwise direction. Furthermore, element 18 can be comprised of a flexible piezo-electric bimorph crystal, and electrical signal means 52 can be electrically coupled to the element for also controlling the position of that end of the element adjacent the power nozzle. Electrical signal means 52 can be comprised of a signal source, and a transformer and a variable capacitor connected in parallel therewith, as shown and more fully described in U.S. Pat. No. 3,269,419. Still further, element 18 can be comprised of a magnetic material, such that the position of end 20 of element 18 is controlled by magnetic means. Thus, by controlling the position of that end of element 18 adjacent the power nozzle by the above described means, control over the directional flow of the power jet exiting the power nozzle can be satisfactorily accomplished upstream of the power nozzle so as not to interfere with the operation of a device that may be located downstream from the power nozzle.

Figure 2:
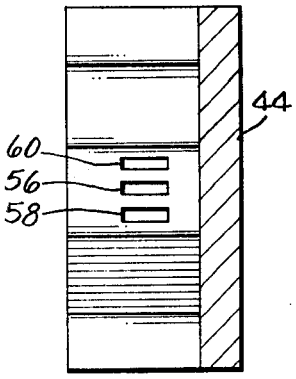
FIG. 2 is a side sectional view of the amplifier shown in FIG. 1 taken along lines 2—2 showing the receiver ports.

Fluidic device 10, shown in FIGS. 1 and 2, can form part of a fluidic amplifier 54 having respective first, second and third fluidic receivers 56, 58 and 60. Receiver 56 has a passageway 62, aligned with axis 22 of power nozzle 16, and an output port 64. Receiver 58 has a passageway 66, angularly displaced in a first direction from axis 22 of power nozzle 16, and an output port 68. Receiver 60 has a passageway 70, angularly displaced in a second direction opposite the first direction from the axis of power nozzle 16, and an output port 72.

In operation, when end 20 of element 18 is in alignment with axis 20 of power nozzle 16, the vectors of the jet flow exiting power nozzle 16 are such that the directional flow of the power jet is in alignment with passageway 62 of receiver 56, and no fluidic signal is received or sensed by receivers 58 and 60. When end 20 of element 18 is shifted in the first direction (counterclockwise as shown in FIG. 1) from the axis of the power nozzle, by the previously described manual, mechanical, electrical or magnetic means, the directional flow of the power jet exiting nozzle 16 shifts towards passageway 66 of receiver 58. Similarly when end 20 of element 18 is shifted in the second direction (clockwise as shown in FIG. 1) from the axis of the power nozzle, by the above described means, the directional flow of the power jet exiting power nozzle 16 shifts towards passageway 70 of receiver 60. In this manner, and depending upon the means used for varying the position of end 20 of element 18, fluidic amplifier 54 can operate as either a proportional or digital amplifier.

Amplifier 54 can be constructed of a suitable solid structural material, such as metal or plastic, or it can have a laminated structure which is comprised of a suitable material, such as stainless steel.

Although the invention has been described with reference to a specific embodiment thereof, numerous modifications are possible without departing from the invention, and it is desirable to cover all modifications falling within the spirit and scope of this invention.

What I claim as new and desire to secure by Letters Patent of the United States is:

1. A fluidic device having a plenum chamber, an input port to said plenum chamber for receiving a supply of fluid, and a power nozzle contiguous with said plenum chamber for generating a power jet, said device including means located upstream of said power nozzle for controlling the directional flow of the power jet exiting said power nozzle, said controlling means comprising:

a. a plate defining one end wall of said plenum chamber and having a sharp edged orifice formed within said plate to define said power nozzle;

b. an elongated movable transducer element positioned within said plenum chamber and surrounded by the gas therewithin, one end of said element being positioned adjacent said power nozzle; and c. means for changing the position of said one end of said element relative to said power nozzle for controlling the directional flow of the power jet exiting said power nozzle, said changing means including:

i. adjustible means for applying a fixed mechanical bias to said transducer element; and ii. signal means coupled to said transducer element for varying the position of said one end of said transducer element adjacent said power nozzle in response to corresponding variations in said signal means.

2. A fluidic device according to claim 1, wherein another end of said element is fixed within another end wall of said plenum chamber, said other end wall being opposite said one end wall, and said element is cantilevered within said plenum chamber.

3. A fluidic device according to claim 2, wherein said element is centrally positioned within said plenum chamber.

4. A fluidic device according to claim 1, wherein said adjustible means is comprised of:

a. a control screw threaded through a tapped hole in a side wall of and extending into said plenum chamber; and b. a spring positioned within said plenum chamber for biasing said element, one end of said spring being fixed to said control screw, and another end of said spring fixed to said element.

5. A fluidic device according to claim 4, wherein said element is comprised of a piezo-electric bimorph crystal.

6. A fluidic device according to claim 5, wherein said signal means is comprised of electrical signal means electrically coupled to said element for controlling the position of said one end of said element adjacent said power nozzle.

7. A fluidic amplifier comprising:

a. a fluidic device having a plenum chamber, an input port to said plenum chamber for receiving a supply of gas, and a power nozzle contiguous with said plenum chamber for generating a power jet, said device including means located upstream of said power nozzle for controlling the directional flow of the power jet exiting said power nozzle, said controlling means comprising:

1. a plate defining one end wall of said plenum chamber and having a sharp edged orifice formed within said plate to define said power nozzle;

2. an elongated flexible transducer element positioned within said plenum chamber and surrounded by the gas therein, one end of said element being normally axially aligned with and located adjacent said power nozzle; and

3. means for changing the position of said one end of said element relative to the axis of said power nozzle for controlling the directional flow of the power jet exiting said power nozzle, said changing means including:

i. adjustible means for applying a fixed mechanical bias to said transducer element; and ii. signal means coupled to said transducer element for varying the position of said one end of said transducer element adjacent said power nozzle in response to corresponding variations in said signal means; and b. first and second fluidic receivers positioned downstream from said power nozzle, said first receiver being axially aligned with said power nozzle for receiving the power jet when said element is normally axially aligned with said power nozzle, and said second receiver being angularly displaced in a first direction from the axis of said power nozzle for receiving the power jet when the position of said one end of said element is varied in the first direction relative to the axis of said power nozzle.

8. A fluidic amplifier according to claim 7, further comprising a third fluidic receiver angularly displaced in a second direction opposite the first direction from the axis of said power nozzle for receiving the power jet when the position of said one end of said element is varied in the second direction relative to the axis of said power nozzle.

9. A fluidic amplifier according to claim 8, wherein another end of said element is fixed within another end wall of said plenum chamber, said other end wall being opposite said one end wall, and said element is cantilevered within said plenum chamber.

10. A fluidic amplifier according to claim 9, wherein said element is centrally positioned within said plenum chamber.

11. A fluidic amplifier according to claim 7, wherein said adjustible means is comprised of:

a. a control screw threaded through a tapped hole in a side wall of and extending into said plenum chamber; and b. a spring positioned within said plenum chamber for biasing said element, one end of said spring being fixed to said control screw, and another end of said spring fixed to said element.

12. A fluidic amplifier according to claim 11 wherein said element is comprised of a piezo-electric bimorph crystal.

13. A fluidic amplifier according to claim 12, wherein said signal means is comprised of electrical signal means electrically coupled to said element for controlling the position of said one end of said element adjacent said power nozzle.

* * * * *